US005386756A

United States Patent [19]

Stehle et al.

[11] Patent Number: 5,386,756

[45] Date of Patent: Feb. 7, 1995

[54] SAW CHAIN FOR A MOTOR-DRIVEN CHAIN SAW

[75] Inventors: Hans P. Stehle, Winnenden; Norbert Apfel, Waiblingen; Hans-Joachim Beyer, Ennigerloh, all of Germany

[73] Assignee: Andreas Stihl, Waiblingen, Germany

[21] Appl. No.: 112,222

[22] Filed: Aug. 27, 1993

[30] Foreign Application Priority Data

Aug. 27, 1992 [DE] Germany ..... 4228509

[51] Int. Cl.[6] ..... B27B 33/14

[52] U.S. Cl. ..... 83/830; 30/123.4

[58] Field of Search ..... 83/830, 831, 832; 30/123.4, 381

[56] References Cited

U.S. PATENT DOCUMENTS

| | | | |
|---|---|---|---|
| 1,397,026 | 11/1921 | Wolf | 30/123.4 |
| 3,292,670 | 12/1966 | Ratz et al. | 30/123.4 |
| 3,478,787 | 11/1969 | Piller | 30/123.4 |
| 4,434,556 | 3/1984 | Nitschman et al. | 30/123.4 |
| 4,558,621 | 12/1985 | Nitschman et al. | 83/830 |
| 4,934,052 | 6/1990 | Nitschman et al. | 30/123.4 |

FOREIGN PATENT DOCUMENTS

| | | | |
|---|---|---|---|
| 1390071 | 1/1965 | France . | |
| 1453167 | 2/1969 | Germany . | |
| 3207326 | 9/1983 | Germany | 83/830 |

*Primary Examiner*—Kenneth E. Peterson
*Attorney, Agent, or Firm*—Walter Ottesen

[57] ABSTRACT

The invention relates to a saw chain for a motor-driven chain saw equipped with a guide bar and a drive motor for imparting a force to the saw chain for moving the latter around the guide bar in a predetermined running direction. The chain saw is further equipped with a device for supplying lubricating oil to the saw chain during the movement thereof. The saw chain includes a plurality of cutting links, a plurality of driving links and a plurality of side links all pivotally interconnected by rivets. Abrasive small particles become entrained in the lubricating oil which can lead to premature wear at the pivot locations. The saw chain of the invention includes a hold-back element in front of a rivet to hold back such particles and yet not affect the flow of lubricating oil to the pivot connection.

38 Claims, 7 Drawing Sheets

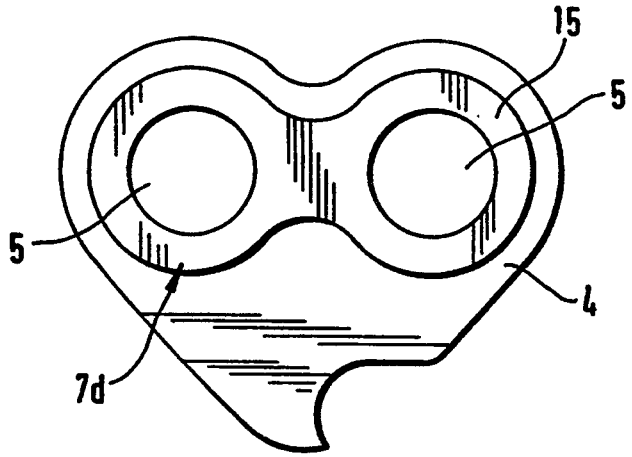
Fig. 7
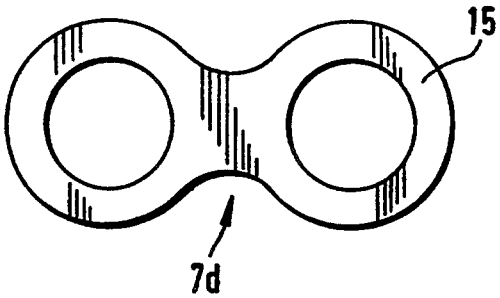
Fig. 7a
Fig. 8
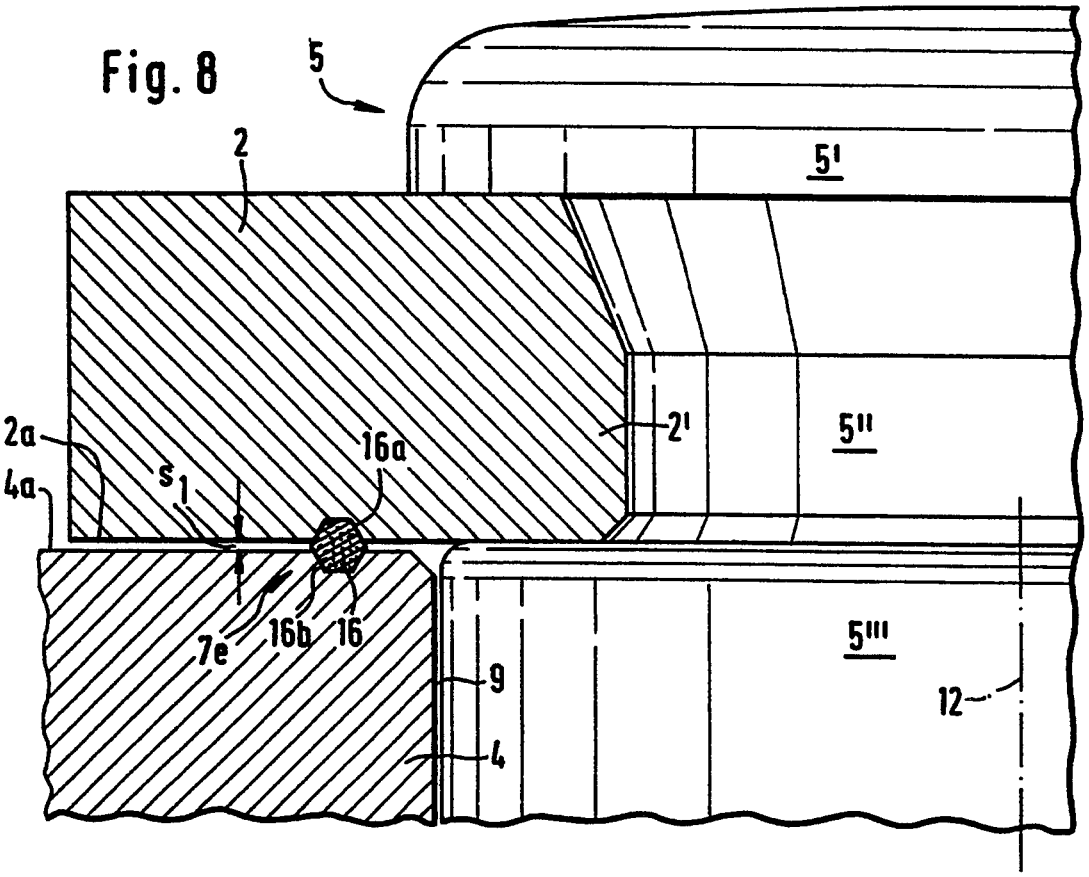

SAW CHAIN FOR A MOTOR-DRIVEN CHAIN SAW

FIELD OF THE INVENTION

The invention relates to a saw chain for motor-driven chain saws having a plurality of right and left cutting links, side links as well as drive links all pivotally interconnected.

BACKGROUND OF THE INVENTION

Saw chains for motor-driven chain saws comprise center drive links with right and left cutting links alternating on the longitudinal sides of the drive links as well as side links likewise alternating on the longitudinal sides of the drive links. All links are pivotally connected one to the other, for example, with pivot bolts. A spacing gap is disposed between the cutting links and the corresponding next adjacent drive links and a spacing gap is provided between the side links and the drive links so that lubricating oil can reach the pivot locations and the rivets. This provides lubrication for the saw chain and therefore maintains the pivoting action and reduces wear. The lubricating oil is absolutely necessary.

Published German patent application 1,453,167 discloses a groove-shaped oil supply in the side flanks of the chain links in order to improve this important lubrication of the pivot locations. Annular grooves are suggested in French patent publication 1,390,071 to improve the oil feed to the saw chain rivets.

In practice, it has been known and accepted for decades that not only lubricating oil enters through the necessary oil supply gap between mutually adjacent chain links but also the most varied dirt particles and that these particles can reach the rivets and cause increased wear at the bearing locations of the chain links and therefore cause premature wear. The dirt particles are unavoidably present when working with the chain saw and include the finest grains of sand, metal particles and the like. This is especially disadvantageous for saw chains having small parts as is the case for motor chain saws made for home use. In these chain saws, the chain links are precision small parts having a longitudinal length of approximately 10 to 20 mm and having rivet connections of approximately 9.525 mm.

SUMMARY OF THE INVENTION

It is an object of the invention to provide measures with chain saws of this kind which prevent the entry of abrasive particles to the rivet connections while at the same time not affecting the oil flow to the pivot connections.

The saw chain of the invention is for a motor-driven chain saw equipped with a guide bar and a drive motor for imparting a force to the saw chain for moving the latter around the guide bar in a predetermined running direction (F). The chain saw is further equipped with lubricating oil supply means for supplying lubricating oil to the saw chain into which oil unwanted particles become entrained during the movement thereof around the guide bar. The saw chain includes: a plurality of cutting links, a plurality of driving links and a plurality of side links, the links being pivotally interconnected by rivets to define the saw chain; each of the driving links having two side flanks; each of the cutting links having a lower portion defining a cutting link side flank facing one of the driving link side flanks thereby providing a first pair of mutually adjacent side flanks through which one the rivets passes; each of the side links having a side link side flank facing the other one of the driving link side flanks thereby providing a second pair of mutually adjacent side flanks through which said one of the rivets passes; the first pair of mutually adjacent side flanks defining a first spacing gap for conducting a portion of the oil to the rivet; the second pair of mutually adjacent side flanks defining a second spacing gap for conducting a further portion of the oil to the rivet; the first and second spacing gaps extending in the running direction (F); and, hold-back means disposed in at least one of the spacing gaps adjacent the rivet for holding back the entrained particles while allowing the lubricating oil to reach the rivet.

According to a feature of the invention, a hold-back element is provided at least in the region of the spacing gap located forward of a rivet. The hold-back element holds back the abrasive particles in the oil and nonetheless allows the oil to pass to the pivot locations, that is, to the rivets.

Such a hold-back element for abrasive particles in the oil acts as a seal or hold-back filter which holds back the particles in the oil flow and therefore holds these particles back from the pivot location. Accordingly, particles causing wear during the operation are held back so that they cannot reach the pivot location.

The hold-back elements according to the invention are advantageously provided in the spacing gaps between the lower portion of the cutting link and the adjacent drive link as well as in the spacing gaps between the drive links and the side links. In this way, all pivot locations present in a saw chain and defined by rivets or the like are protected from receiving abrasive solid particles.

In a preferred embodiment, these hold-back elements are arranged concentrically to the connecting rivets.

In an embodiment of the invention which is simple to produce, a side flank of a chain link delimiting the spacing gap is provided with a projection which defines a baffle for the inflowing oil. The baffle rerouts or deflects the oil flow or narrows this gap in such a manner that, because of the obstacle in the oil flow provided in this manner, solid abrasive particles are prevented from reaching the region of the rivet connection. Several such projections which deflect or rerout the oil flow can be provided in a spacing gap so that such baffles can lie one behind the other when viewed in the direction of the inflowing oil.

In the above embodiment, baffles in the form of projections extend into the spacing gap for the oil supplied to the rivets. In this embodiment, it is advantageous to provide recesses which are adapted to corresponding ones of the projections in the opposite-lying chain link so that a multiple deflection of the oil flow takes place in a labyrinth-like manner without narrowing the cross section of the spacing gap. In this way, solid abrasive particles are held back with special effectiveness and are thereby prevented from flowing to the rivets with the inflowing lubricating oil. The projections and recesses interdigitally engage in almost a interlocking manner and can have any desired form when viewed in cross section. Thus, the cross section can be wave-shaped, meander-shaped, triangularly-shaped, sawtooth-shaped or be configured in any other manner.

In lieu of the interlocking interdigitally engaging hold-back elements in the region of the side flanks of opposite-lying chain links, the hold-back elements can be configured as inserts which reduce or narrow the oil gap and can have the form, for example, of planar very thin plates made of spring steel or spring foil. The plate then reduces the oil gap and defines a baffle for the solid particles entrained in the oil. It is also conceivable to provide a seal permeable to the oil as a hold-back element between mutually adjacent side flanks in the spacing gap for the oil feed. The seal can, for example, be a porous sealing ring or a sealing ring provided with the very small channels.

BRIEF DESCRIPTION OF THE DRAWINGS

The invention will now be described with reference to the drawings wherein:

FIG. 7 is an embodiment of a hold-back device in the form of a cover plate which is seated in the manner of a spectacles frame on mutually adjacent rivets;

FIG. 7*a* shows the cover plate of FIG. 7 as an individual part;

FIG. 8 is a further embodiment of the hold-back device shown in an enlarged cross section through the lower portion of the cutting link and through the drive link with the embodiment here being in the form of an inserted ring;

DESCRIPTION OF THE PREFERRED EMBODIMENTS OF THE INVENTION

Figure 1:
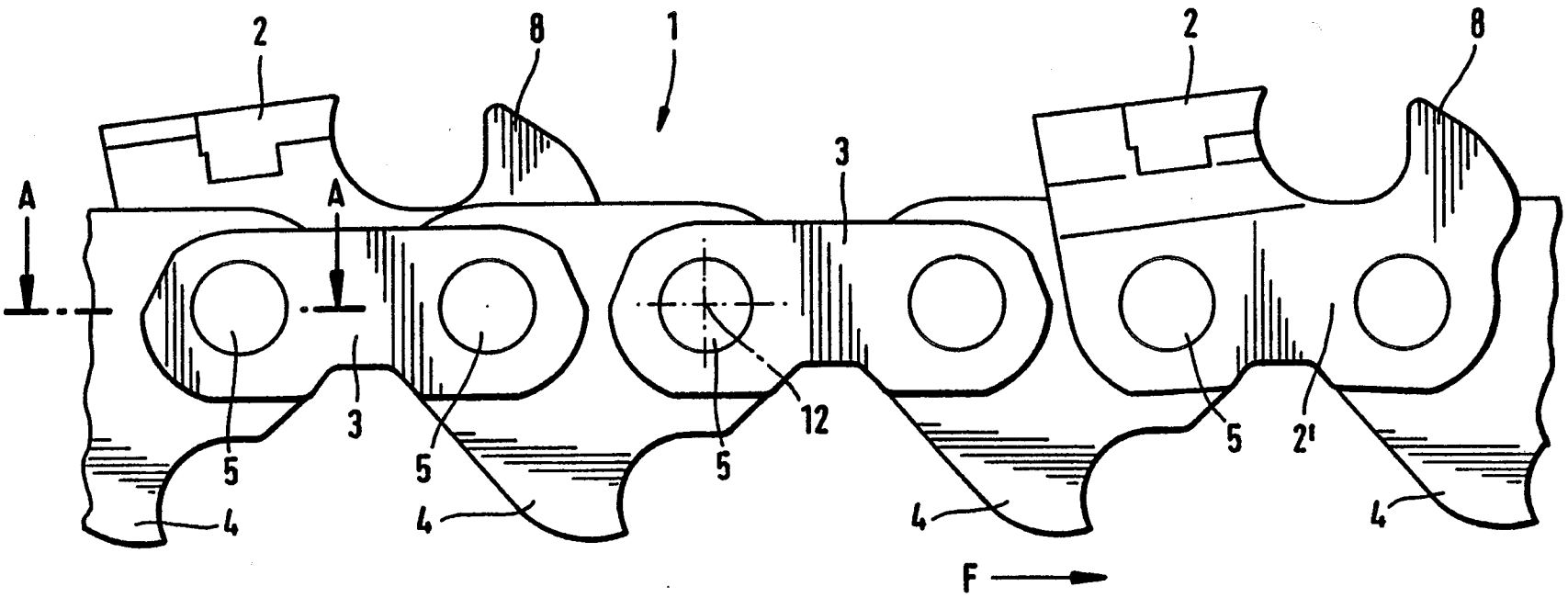
FIG. 1 is a side elevation view of a segment of a saw chain.

As shown in FIG. 1, a saw chain 1 for a motor-driven chain saw has right and left cutting links 2, side links 3 as well as drive links 4 disposed between the cutting links and side links. The links are pivotally connected by rivets 5. The side flanks 2*a* of the cutting-link feet 2' are preferably configured so as to be planar. The side flanks 4*a* of the drive links are likewise planar.

Figure 2:
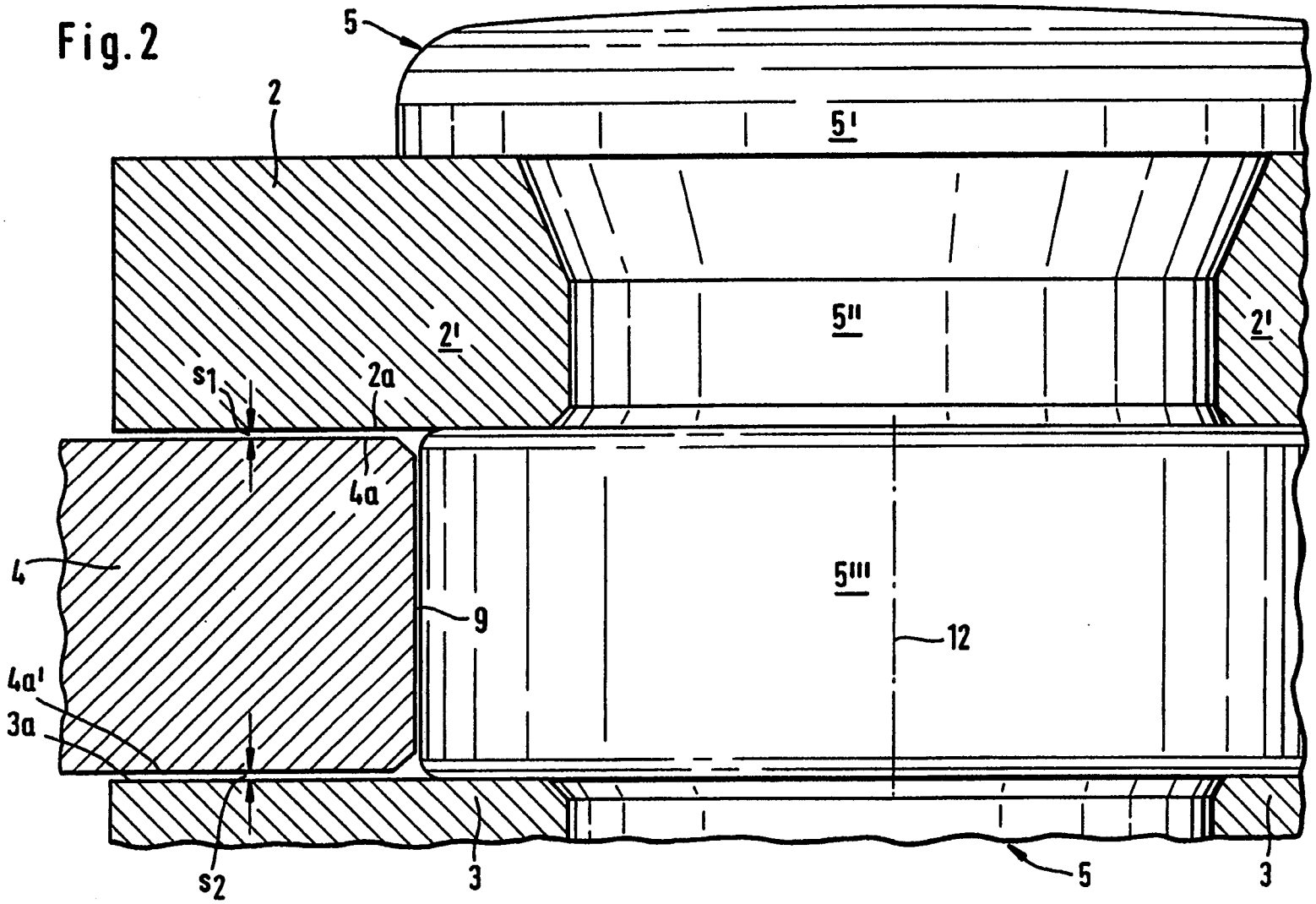
FIG. 2 is a section view taken along section line A—A of FIG. 1.

As shown in FIG. 2, a spacing gap $s_1$ is provided between the side flanks 2*a* of the cutting-link feet 2' and the side flanks 4*a* of the drive links 4 and a spacing gap $s_2$ is provided between the side flanks 3*a* of the side links 3 and the side flanks 4*a'* of the driving links 4. The spacing gaps $s_1$ and $s_2$ each extend in the running direction (F) of the chain 1 and the lubricating oil can reach the rivet connections or rivets 5 through these spacing gaps.

The spacing gaps $s_1$ and $s_2$ have a gap width of 0.04 mm in known chain saws such as those provided for the home user with the rivet connection being 9.525 mm. The spacing gaps $s_1$and $s_2$ extend in the running direction (F) perpendicularly to the axes 12 of the connecting rivets 5. The connecting rivets 5 comprise a rivet head 5', a rivet shank 5'' and a rivet collar 5'''. The gaps $s_1$ and $s_2$ concentrically surround the rivet collar 5''' and, in the known embodiments, the gap $s_1$ is conjointly defined by the planar side flanks 2*a* of the cutting-link foot 2' of the cutting link 2 and the side flanks 4*a* of the driving links 4 which are planar-parallel to the side flanks 2*a* while, on the other hand, the gap $s_2$ is defined by the planar side flanks 4*a'* of the driving links 4 and the side flanks 3*a* of the side links 3. The actual pivot location between driving link 4 and the rivet 5 is in the region of each rivet opening 9 of the driving link 4 and the rivet collar 5'''. These pivot locations are subjected to intense wear and are supplied with oil which can reach these pivot locations via the gaps $s_1$ and $s_2$.

As mentioned above, the supplied lubricating oil contains abrasive solid particles such as the finest sand grains or metal particles which can perforce become entrained with the lubricating oil and therefore also reach the pivot locations of the rivets 5 when working with the chain saw. This leads to premature wear at the pivot locations.

According to the invention, hold-back elements are provided in the regions of the spacing gaps $s_1$ or $s_2$ (preferably in both gaps) disposed forward of the rivets 5 when viewed in the running direction (F) of the saw chain 1. These hold-back elements are provided to prevent the above-mentioned abrasive particles from reaching the pivot locations between the driving links and the rivets 5 and especially from reaching the rivet collar 5'''. The hold-back elements define so-called baffles in the flow path of the oil in such a manner that the fine solid particles are held back from the pivot locations by means of these baffles or obstacles in the oil flow; whereas, the lubricating oil can reach the pivot locations in an adequate quantity.

Figure 4:
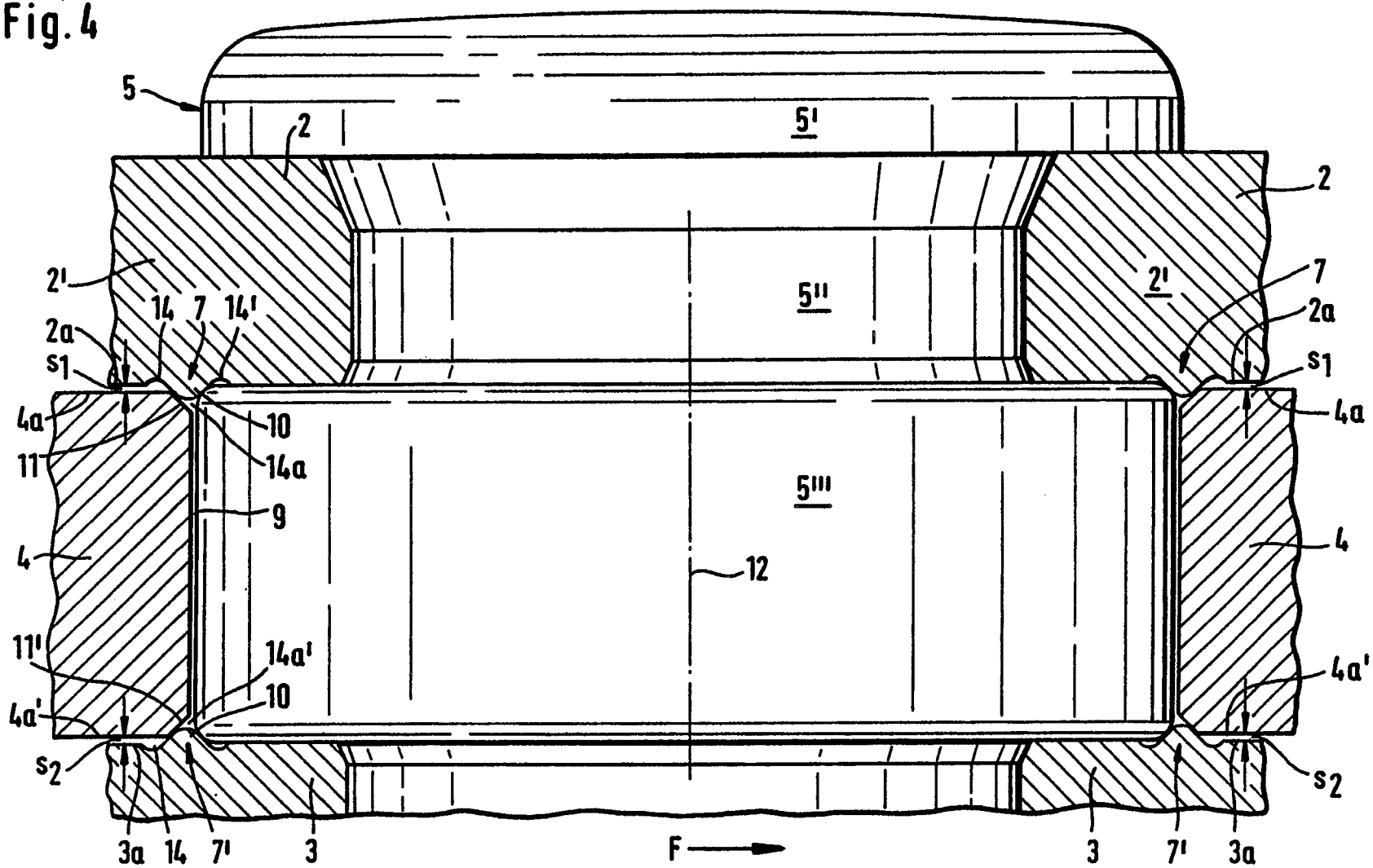
FIG. 4 is another embodiment of the invention viewed in the same manner as the embodiment of FIG. 2.

In all embodiments, the hold-back elements are provided in the region of the spacing gap $s_1$ as well as in the spacing gap $s_2$ whereby all pivot locations of the saw chain are protected from abrasive particles entrained in the inflowing oil (see FIG. 4). The hold-back elements shown for all embodiments are arranged concentrically to the periphery of the connecting rivets 5 so that the connecting rivets and their pivot locations are protected around the periphery thereof. However, it is also conceivable to provide a simplified embodiment wherein the rivet collar 5''' is protected only forwardly and rearwardly when viewed in the running direction (F), for example, by means of quarter bushings or half bushings.

Figure 3:
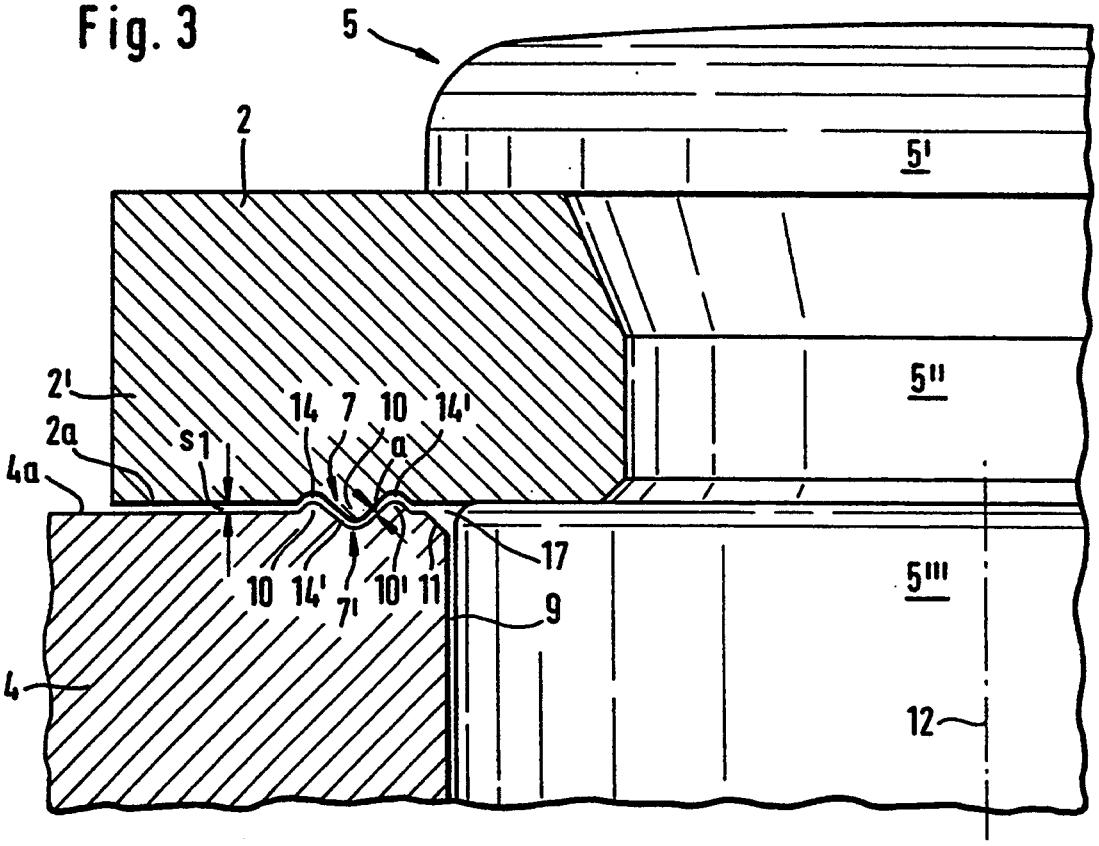
FIG. 3 is an enlarged illustration of a first embodiment of the invention wherein the hold-back element is shown only between the foot of the cutting link and the next-adjacent drive link.

An embodiment of the hold-back element 7 is shown in FIG. 3. This hold-back element comprises a circularly-shaped projection 10 of the side flank 2*a* of the foot 2' of a cutting link 2. Recesses (14, 14') of the side flank 2*a* are provided on both sides of the projection 10 into which projections (10, 10') of the flank 4*a* of the next-adjacent driving link 4 engage in the manner of an interlock. The projections (10, 10') are formed with a corresponding spacing (a). The required oil feed gap $s_1$ is therefore approximately wave-shaped or sinusoidally rerouted so that the solid abrasive particles entrained in the lubricating oil in the spacing gap $s_1$ cannot reach the actual pivot interface between rivet collar 5''' and rivet opening 9 because they are held back because of this rerouting. The hold-back elements (7, 7') in this way, define an obstacle or a baffle for the lubricating oil flowing in the gap $s_1$ toward the pivot location. An inclined bevel 11 is provided in the region of the rivet opening 9 of the driving link 4 by means of which an annularly extending groove 17 is formed for storing the lubricating oil in the region of the rivet opening 9, that is, directly at the pivot location.

A simplified embodiment is conceivable wherein, for example, a projection is provided narrowing the gap (s), for example, only on the side flank 2a of the foot 2' of the cutting link or on the side flank 4a of the driving link 4 without, as in the embodiment of FIG. 3, it being necessary to provide an interdigitally engaging wave-shaped, meander-shaped, sawtooth-shaped or triangular projection. In the embodiment of FIG. 3, the gap width of the spacing gap $s_1$is 0.04 mm. This gap width is maintained via hold-back elements (7, 7') in the form of interdigitally engaging projections so that the spacing (a) of the interdigitally engaging projections has the same gap width. The gap width (a) can, in a particular application, also be less than the width of the spacing gap $s_1$.

Figure 3A:
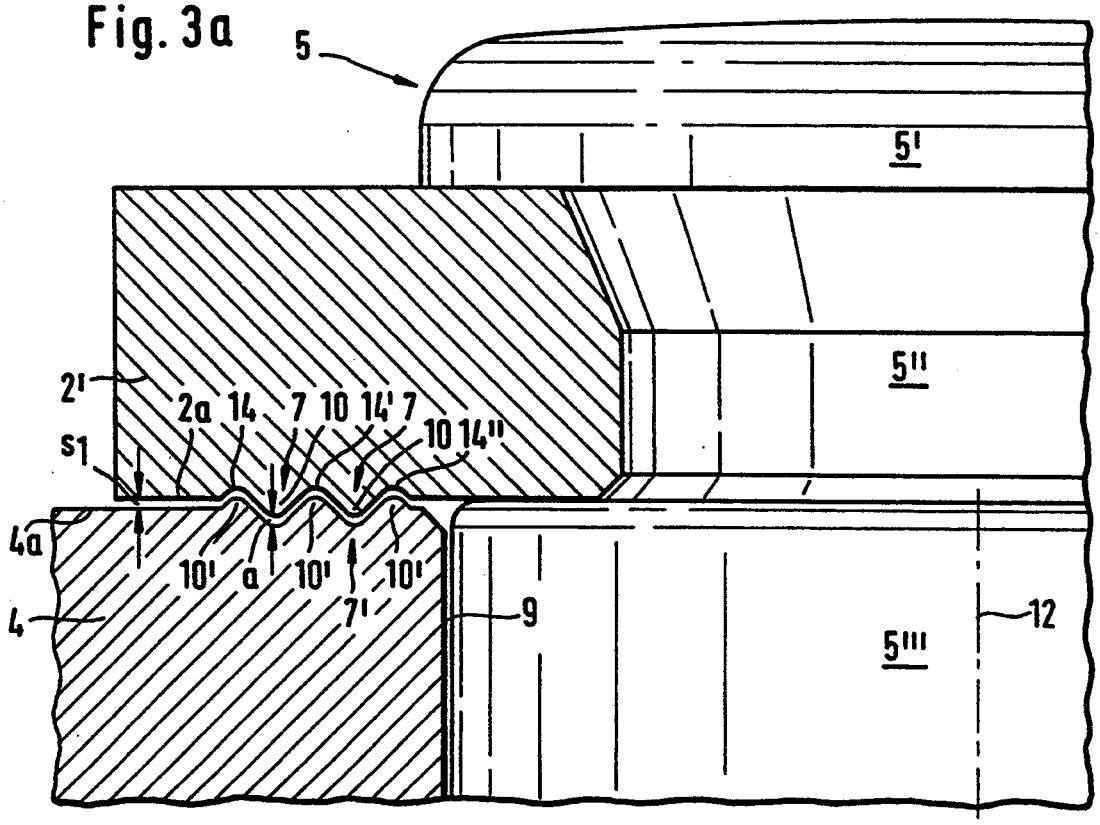
FIG. 3*a* is a variation of the hold-back element in the same view as seen in FIG. 3.

FIG. 3a shows an embodiment wherein basically the same hold-back elements (7, 7') are provided as in the embodiment of FIG. 3. However, here, two projections (10, 10) are impressed in the foot 2' of the cutting link so as to lie one behind the other when viewed in the direction of movement (F) and, correspondingly, three recesses (14, 14' 14'') are impressed in the side flanks 2a. These projections or recesses correspond to three projections 10' of the side flank 4a of the driving link. 4 while allowing an oil feed gap to remain between the interengaging wave-shaped hold-back elements (7, 7') with a precisely dimensioned gap width (a) likewise being provided. In both embodiments of FIGS. 3 and 3a, at least two circularly-shaped projections (10, 10 and 10, 10') are arranged to lie one behind the other when viewed in the running direction of the saw chain 1. These projections define a labyrinth-like pass-through gap (a) for the lubricating oil and are suitable to prevent damaging abrasive particles from reaching the actual pivot location of the rivet collar 5''' in the region of the rivet opening 9 of the driving link 4.

As can be seen in FIGS. 3 and 3a, the hold-back elements (7, 7') are preferably arranged in the vicinity of the pivot location (9, 5''').

The embodiment of FIG. 4 shows a configuration wherein the hold-back elements (7, 7') lie directly at the pivot location, that is, directly in the region of the pivot opening 9 of the driving link 4 and the end face of the rivet collar 5'''. In this embodiment, the hold-back element 7 is likewise defined by a rounded projection 10 in the side flank 2a of the foot 2' together with adjoining recesses (14a, 14a') in such a manner that the hold-back element extends approximately in a wave shape. Here, the projection 10 engages in the recess 14a between the rivet collar 5''' and the rivet opening 9 of the driving link. The recess 14a is defined by an inclined bevel 11 in the inside surface of the opening 9 so that special recesses in the side flanks 4a of the driving links 4 are not required.

A corresponding configuration is provided between mutually opposite lying flanks 4a' of the driving link 4 and the corresponding flank 3a of the side link 3 in that the projection 7' of the side link 3 fits into the recess 14a' defined by the bevel 11'. The hold-back elements (7, 7') also here cause a deflection of the oil flow directly forward of the pivot location between the rivet collar 5''' and driving link 4. The oil flow enters via the gaps $s_1$ and $s_2$ and the deflection has the effect that solid particles are held back directly at the entrance to the pivot location to be lubricated and are caused to be deposited in the recesses (14, 14) which lie forward of the projections 10. The recesses (14a, 14a') lie in the region of the projections (10, 10) in FIG. 4 and define a kind of store for the lubricating oil from which the solid particles have been separated.

Figure 5:
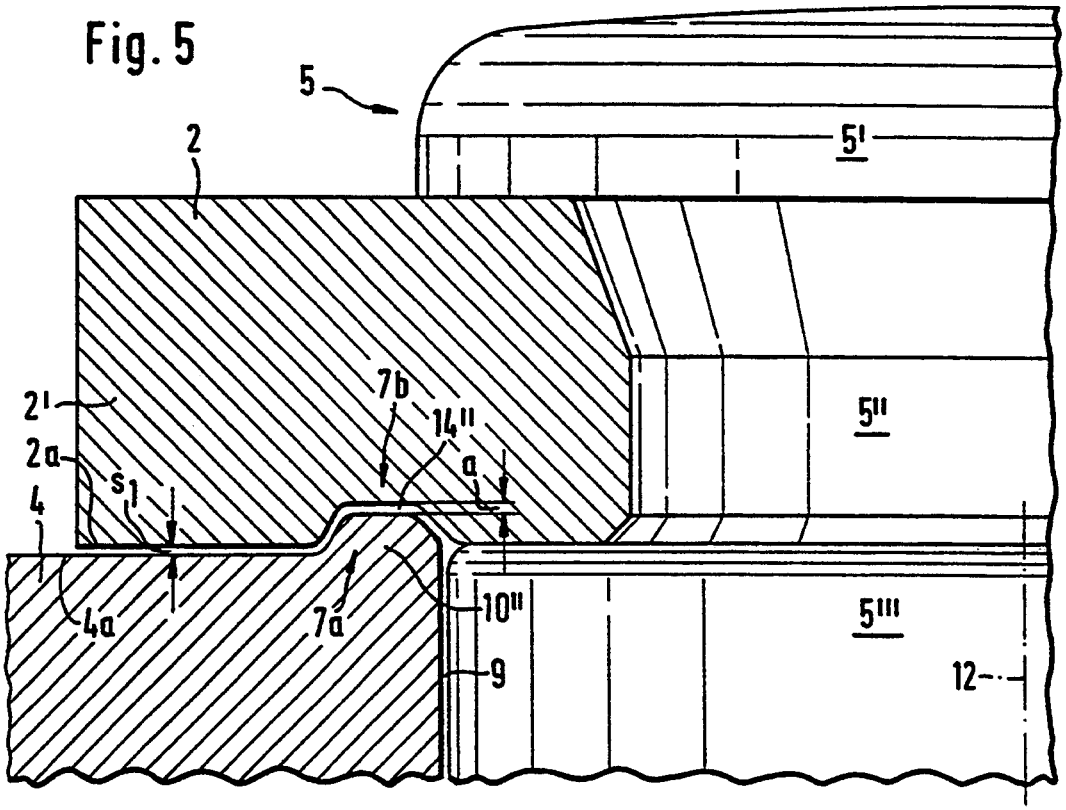
FIG. 5 is a further embodiment of the invention viewed in the same manner as the embodiment of FIG. 3.

In the embodiment of FIG. 5, the hold-back elements (7a, 7b) in the side flanks of the driving link 4 and the foot 2' of the cutting link are provided directly in the edge region of the rivet opening 9 of the driving link 4 in such a manner that the projection 10'' extends beyond the side flank 4a in a circularly-shaped manner when viewed in the axial direction 12 of the rivet 5 and fits into a correspondingly adapted recess 14'' in the foot 2' of the adjacent cutting link. In this way, a gap (a) is maintained which preferably has the magnitude of the spacing gap $s_1$ for the oil feed. The cross section of the projection 10'' and the corresponding recess 14'' can preferably be meander-shaped or have an approximately trapezoidal shape. Also, the width of the gap (a) between the projection 10'' and recess 14 can be made smaller than the width of the gap $s_1$.

The hold-back elements (7a, 7b) are preferably symmetrical to the axis 12 of the rivet 5 in the same manner as the embodiments (7, 7') described above. The embodiment of FIG. 5 then defines a labyrinth seal which likewise holds back solid particles and which simultaneously defines a reinforcement of the driving link 4 in the region of the rivet opening 9 and is relatively simple to produce and easy to assemble because the saw chain bearing is here sealed by a tongue and groove joint. The production of this hold-back element (7a, 7b) can take place in that the driving link 4 is slightly deformed on both sides 4a, for example, by being pressed by about 0.3 mm.

Figure 6:
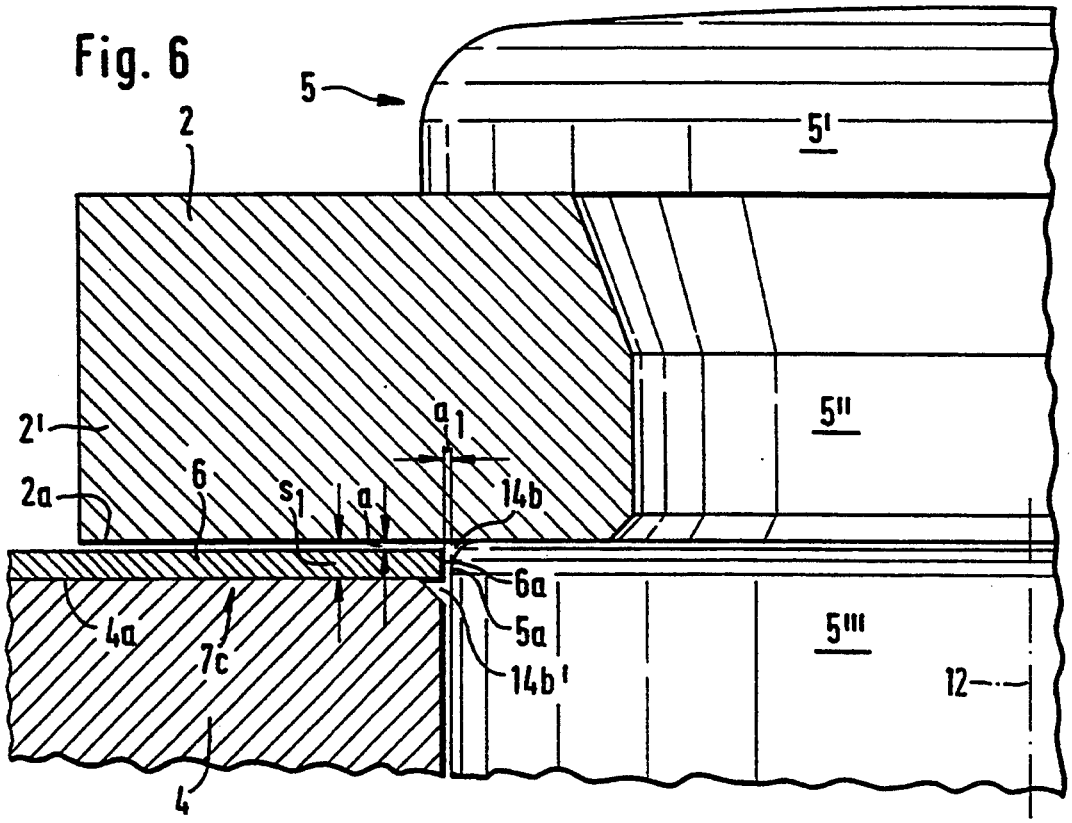
FIG. 6 is still another embodiment of the invention wherein a hold-back device is in the form of a sealing disc between the foot of the cutting link and the driving link.

FIG. 6 shows an embodiment of a hold-back element 7c wherein a sealing plate 6 is inserted into the gap $s_1$ between the foot 2' of the cutting link 2 and the flank 4a of the driving link 4. The sealing plate 6 made of spring steel or the like defines a baffle for the incoming oil flow and, at the same time, reduces the gap $s_1$ so that solid particles are held back at the entrance to the narrower width (a). The inserted sealing plate is preferably configured so as to be planar and extends close up to the periphery of the rivet collar 5'''. In this way, a recess is obtained in the form of a gap ($a_1$) between the periphery of the rivet collar 5''' and the narrow end 6a of the seal plate 6 and, at both ends of this seal plate 6, respective recesses (14, 14') remain as annularly-shaped collecting spaces for the lubricating oil. The sealing plate provided here can also be made of a spring-steel foil and have a thickness of approximately 0.03 mm to 0.2 mm.

The embodiments of FIGS. 7 and 7a show a hold-back element 7d in the form of a cover plate 15 which encloses mutually-adjacent rivets (5, 5) and is configured in the nature of a spectacles frame so that the spacing gap bordering thereon for the feed of the oil is narrowed in its cross section by this hold-back plate in such a manner that the above-described hold-back action for abrasive solid particles is realized. The arrangement can be such that a spectacles-shaped cover plate 15 is provided on each end of the rivets (5, 5) of the drive link 4. The arrangement corresponding to FIG. 7 then defines a covered bearing, for example, for a driving link having a magnitude of 8.255 mm. A material for the spring band foil can be steel having a thickness of 0.05 mm. The spectacles-shaped cover plate 15 can be arranged at both ends of the rivets 5.

Another embodiment of the invention (FIG. 8) provides that the hold-back element 7*e* is provided between the side flanks 2*a* of the foot 2' of the cutting link 2 and the side flank 4*a* of the driving link 4 as well as in the corresponding side flanks of the driving link 4 and side link 3 (not shown). The hold-back element 7*e* can then be configured in such a manner that an oil-permeable sealing ring 16 is used which is preferably produced by injection molding. The sealing ring 16 can be seated in corresponding recesses 16*a*, 16*b* of the flanks 2*a* of the cutting links 2 and the flanks 4*a* of the driving links 4 or the corresponding flanks between the drive link 4 and the side link 3 in such a manner that the spacing gap $s_1$ for the oil feed is partitioned by a ring-shaped filtering sealing element. Solid particles which should not reach the bearing location in the region of the rivet opening 9 are likewise held back while, on the other hand, the lubricating oil can pass through to the pivot location (9, 5''').

Figure 9:
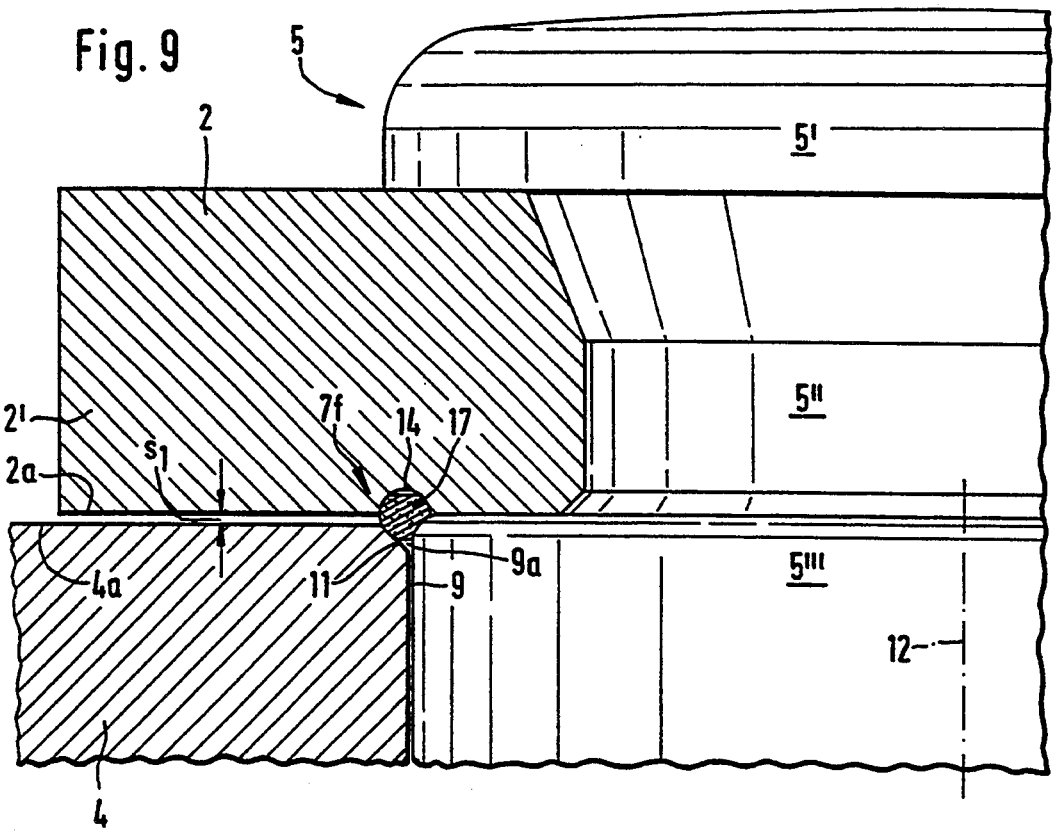
FIG. 9 is another embodiment of the invention viewed in the manner of FIG. 8 wherein a sealing ring is provided directly at the collar of the rivet; and, FIG. 10 is a partial section view taken through a lower portion of a cutting link or side link and the driving link and also showing the rivet with the hold-back element being configured as a sleeve.

A similar embodiment is also shown in FIG. 9 wherein a sealing ring 17 is provided as the hold-back element 7*f*. The sealing ring 17 is seated directly in the region of the rivet opening 9 of the driving link 4 and is likewise permeable to oil. This sealing ring is disposed in a recess 14 of the foot 2' of the cutting link 2 and in a corresponding recess 9*a* of the rivet opening 9. The recess 14 has a cross section approximating a half circle and the recess 9*a* is defined by a bevel 11 in the region of the rivet opening 9.

In this way, a sealed saw chain bearing is provided by means of a sealing ring with the aid of which the entry of abrasive particles to the bearing itself is prevented.

Figure 10:
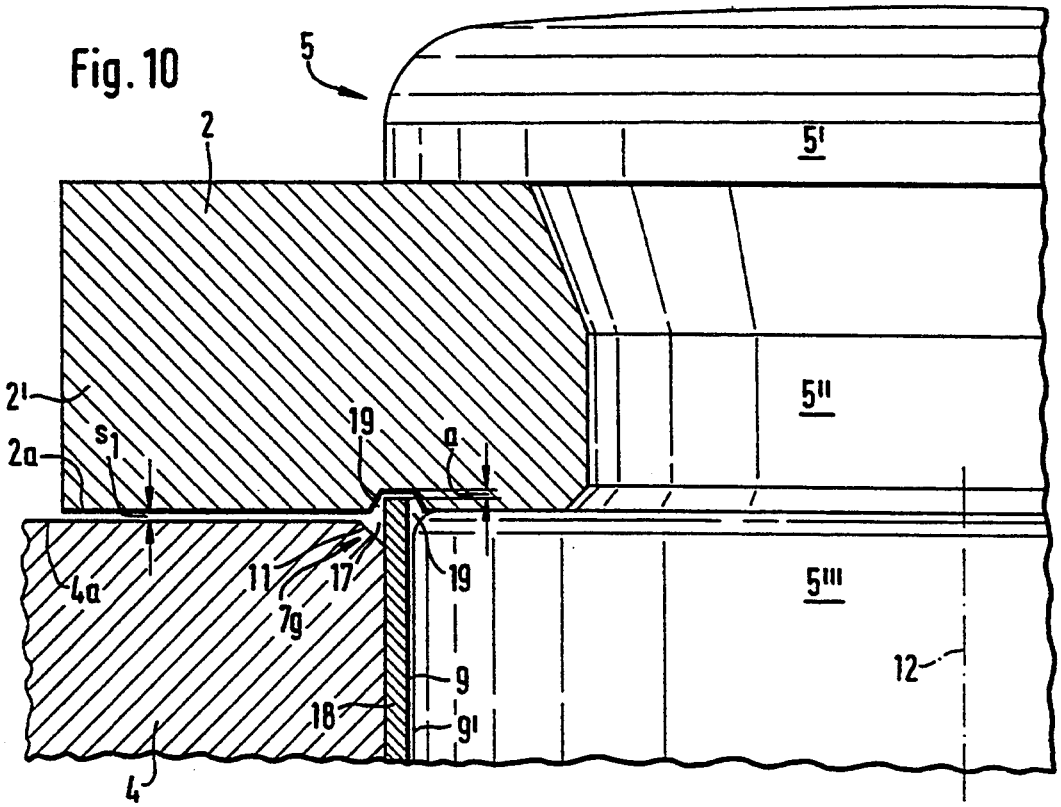

Another embodiment of the hold-back element is shown in FIG. 10. Here, the hold-back element 7*g*is defined by a sleeve 18 which surrounds the ring collar 5''' of the rivet 5 in a sleeve-like manner and has an outer periphery which projects into a recess 19 in the foot 2' of the cutting link 2 in such a manner that a labyrinth-like rerouting or deflection of the gap $s_1$ is provided for the oil feed. Here too, recesses 17, 19 are provided forward and rearward of the sleeve 18 in such a manner that solid particles can collect in the recess 17 while at the same time oil from which the abrasive particles has been removed can flow through the gap (a) into the larger recess 19 for the purpose of storage. The recess 17 borders on the spacing gap $s_1$ and the recess 19 is disposed on the other side of the seal 18. Here too, a play 9' is provided which is necessary for the pivot action between the periphery of the rivet collar 5''' and the sleeve 18, that is, in the region of the rivet opening 9. The sleeve 18 can, for example, have a thickness of 0.1 mm with the pass-through gap (a) being approximately 0.08 mm wide and the bevel 11 for forming the recess 17 can extend from 0.1 mm for a thickness of the driving link 4 of approximately 1.76 mm.

It is understood that the foregoing description is that of the preferred embodiments of the invention and that various changes and modifications may be made thereto without departing from the spirit and scope of the invention as defined in the appended claims.

What is claimed is:

1. A saw chain for a motor-driven chain saw equipped with a guide bar and a drive motor for imparting a force to the saw chain for moving the latter around the guide bar in a predetermined running direction (F), the chain saw being further equipped with lubricating oil supply means for supplying lubricating oil to the saw chain into which oil unwanted particles become entrained during the movement thereof around the guide bar, the saw chain comprising:

a plurality of cutting links, a plurality of driving links and a plurality of side links, the links being pivotally interconnected by rivets to define the saw chain;

each of said driving links having two side flanks;

each of said cutting links having a lower portion defining a cutting link side flank facing one of said driving link side flanks thereby providing a first pair of mutually adjacent side flanks through which one of the rivets passes;

each of said side links having a side link side flank facing the other one of said driving link side flanks thereby providing a second pair of mutually adjacent side flanks through which said one of the rivets passes;

said first pair of mutually adjacent side flanks defining a first spacing gap for conducting a portion of the oil to the rivet;

said second pair of mutually adjacent side flanks defining a second spacing gap for conducting a portion of the oil to the rivet;

said first and second spacing gaps extending in said running direction (F);

hold-back means disposed in at least one of said spacing gaps adjacent the rivet for holding back the entrained particles while allowing the lubricating oil to reach the rivet;

said hold-back means being a first hold-back means disposed in said first spacing gap and said saw chain further including a second hold-back means disposed in said second spacing gap; and, said driving links having a rivet hole formed therein; and, each of said hold-back means including a first recess formed in one of said side flanks in the region of said rivet hole and a second recess formed in the side flank adjacent said one side flank directly opposite said first recess; a sealing ring seated in said recesses so as to extend across the spacing gap; and, said sealing ring being made of a material permeable to the lubricating oil.

2. The saw chain of claim 1, said sealing ring being an injection molded sealing ring.

3. A saw chain for a motor-driven chain saw equipped with a guide bar and a drive motor for imparting a force to the saw chain for moving the latter around the guide bar in a predetermined running direction (F), the chain saw being further equipped with lubricating oil supply means for supplying lubricating oil to the saw chain into which oil unwanted particles become entrained during the movement thereof around the guide bar, the saw chain comprising:

a plurality of cutting links, a plurality of driving links and a plurality of side links, the links being pivotally interconnected by rivets to define the saw chain;

each of said driving links having two side flanks;

each of said cutting links having a lower portion defining a cutting link side flank facing one of said driving link side flanks thereby providing a first pair of mutually adjacent side flanks through which one of the rivets passes;

each of said side links having a side link side flank facing the other one of said driving link side flanks thereby providing a second pair of mutually adjacent side flanks through which said one of the rivets passes;

said first pair of mutually adjacent side flanks defining a first spacing gap for conducting a portion of the oil to the rivet;

said second pair of mutually adjacent side flanks defining a second spacing gap for conducting a portion of the oil to the rivet;

said first and second spacing gaps extending in said running direction (F);

hold-back means disposed in at least one of said spacing gaps adjacent the rivet for holding back the entrained particles while allowing the lubricating oil to reach the rivet;

said hold-back means being a first hold-back means disposed in said first spacing gap and said saw chain further including a second hold-back means disposed in said second spacing gap; and, each of said driving links having a rivet hole formed therein; and, said rivet hole having an opening in the side flank of the driving link; each of said hold-back means including: a groove formed in the side flank of one of said side link and said cutting link in the region of said rivet hole; a recess defined by a bevel at the peripheral edge of said opening of said rivet hole; said groove being approximately semicircular when viewed in section; and, an oil-permeable sealing ring seated in said groove and said recess so as to extend across said spacing gap.

4. A saw chain for a motor-driven chain saw equipped with a guide bar and a drive motor for imparting a force to the saw chain for moving the latter around the guide bar in a predetermined running direction (F), the chain saw being further equipped with lubricating oil supply means for supplying lubricating oil to the saw chain into which oil unwanted particles become entrained during the movement thereof around the guide bar, the saw chain comprising:

a plurality of cutting links, a plurality of driving links and a plurality of side links, the links being pivotally interconnected by rivets to define the saw chain;

each of said driving links having two side flanks;

each of said cutting links having a lower portion defining a cutting link side flank facing one of said driving link side flanks thereby providing a first pair of mutually adjacent side flanks through which one of the rivets passes;

each of said side links having a side link side flank facing the other one of said driving link side flanks thereby providing a second pair of mutually adjacent side flanks through which said one of the rivets passes;

said first pair of mutually adjacent side flanks defining a first spacing gap for conducting a portion of the oil to the rivet;

said second pair of mutually adjacent side flanks defining a second spacing gap for conducting a portion of the oil to the rivet;

said first and second spacing gaps extending in said running direction (F);

hold-back means disposed in at least one of said spacing gaps adjacent the rivet for holding back the entrained particles while allowing the lubricating oil to reach the rivet;

said hold-back means being a first hold-back means disposed in said first spacing gap and said saw chain further including a second hold-back means disposed in said second spacing gap; and, each of said spacing gaps defining a path to the rivet extending therethrough; each of said hold-back means including a sealing element formed on one of said side flanks and a projection formed on the side flank adjacent to said one side flank so as to be directed toward said sealing element so as to rerout said path.

5. A saw chain for a motor-driven chain saw equipped with a guide bar and a drive motor for imparting a force to the saw chain for moving the latter around the guide bar in a predetermined running direction (F), the chain saw being further equipped with lubricating oil supply means for supplying lubricating oil to the saw chain into which oil unwanted particles become entrained during the movement thereof around the guide bar, the saw chain comprising:

a plurality of cutting links, a plurality of driving links and a plurality of side links, the links being pivotally interconnected by rivets to define the saw chain;

each of said driving links having two side flanks;

each of said cutting links having a lower portion defining a cutting link side flank facing one of said driving link side flanks thereby providing a first pair of mutually adjacent side flanks through which one of the rivets passes;

each of said side links having a side link side flank facing the other one of said driving link side flanks thereby providing a second pair of mutually adjacent side flanks through which said one of the rivets passes;

said first pair of mutually adjacent side flanks defining a first spacing gap for conducting a portion of the oil to the rivet;

said second pair of mutually adjacent side flanks defining a second spacing gap for conducting a portion of the oil to the rivet;

said first and second spacing gaps extending in said running direction (F);

hold-back means disposed in at least one of said spacing gaps adjacent the rivet for holding back the entrained particles while allowing the lubricating oil to reach the rivet;

said hold-back means being a first hold-back means disposed in said first spacing gap and said saw chain further including a second hold-back means disposed in said second spacing gap; and, each of said hold-back means including two annular projections formed on one of said side flanks and one annular projection formed on the side flank adjacent to said one side flank so as to be directed toward said two annular projections to define a labyrinth pass-through gap for the lubricating oil.

6. The saw chain of claim 5, said hold-back means further comprising: one annular recess formed between said two annular projections for interdigitally engaging with said one annular projection; and, two annular recesses formed on respective sides of said one annular projection for interdigitally engaging with said two annular projections.

7. The saw chain of claim 6, said one annular recess and said one projection interdigitally engaging therewith and said two annular recesses interdigitally engaging with said two annular projections conjointly having a wave-shaped configuration when viewed in cross section.

8. The saw chain of claim 6, said one annular recess and said one projection interdigitally engaging therewith and said two annular recesses interdigitally engaging with said two annular projections conjointly having a sawtooth configuration when viewed in section.

9. The saw chain of claim 6, said two annular projections and said one annular recess formed on said one side flank and said one annular projection and said two annular recesses formed on said side flank adjacent to said one side flank conjointly defining a gap therebetween corresponding approximately to the magnitude of the spacing gap between said one side flank and said side flank adjacent to said one side flank.

10. A saw chain for a motor-driven chain saw equipped with a guide bar and a drive motor for imparting a force to the saw chain for moving the latter around the guide bar in a predetermined running direction (F), the chain saw being further equipped with lubricating oil supply means for supplying lubricating oil to the saw chain into which oil unwanted particles become entrained during the movement thereof around the guide bar, the saw chain comprising:

a plurality of cutting links, a plurality of driving links and a plurality of side links, the links being pivotally interconnected by rivets to define the saw chain;

each of said driving links having two side flanks;

each of said cutting links having a lower portion defining a cutting link side flank facing one of said driving link side flanks thereby providing a first pair of mutually adjacent side flanks through which one of the rivets passes;

each of said side links having a side link side flank facing the other one of said driving link side flanks thereby providing a second pair of mutually adjacent side flanks through which said one of the rivets passes;

said first pair of mutually adjacent side flanks defining a first spacing gap for conducting a portion of the oil to the rivet;

said second pair of mutually adjacent side flanks defining a second spacing gap for conducting a portion of the oil to the rivet;

said first and second spacing gaps extending in said running direction (F);

hold-back means disposed in at least one of said spacing gaps adjacent the rivet for holding back the entrained particles while allowing the lubricating oil to reach the rivet;

each driving link having two rivet holes for accommodating two of the rivets therein, respectively; said hold-back means including a cover plate arranged in one of said spacing gaps to narrow the width of the one spacing gap in the region of said cover plate; and, said cover plate having a configuration corresponding to a spectacles frame defining two apertures for receiving respective one of the two rivets therein.

11. The saw chain of claim 10, said cover plate being a first cover plate; and, said hold-back means further comprising a second cover plate arranged in the other one of said spacing gaps to narrow the width of said other spacing gap in the region of said second cover plate; and, said second cover plate likewise having a configuration corresponding to a spectacles frame defining two apertures for receiving said two rivets therein, respectively.

12. A saw chain for a motor-driven chain saw equipped with a guide bar and a drive motor for imparting a force to the saw chain for moving the latter around the guide bar in a predetermined running direction (F), the chain saw being further equipped with lubricating oil supply means for supplying lubricating oil to the saw chain into which oil unwanted particles become entrained during the movement thereof around the guide bar, the saw chain comprising:

a plurality of cutting links, a plurality of driving links and a plurality of side links, the links being pivotally interconnected by rivets to define the saw chain;

each of said driving links having two side flanks;

each of said cutting links having a lower portion defining a cutting link side flank facing one of said driving link side flanks thereby providing a first pair of mutually adjacent side flanks through which one of the rivets passes;

each of said side links having a side link side flank facing the other one of said driving link side flanks thereby providing a second pair of mutually adjacent side flanks through which said one of the rivets passes;

said first pair of mutually adjacent side flanks defining a first spacing gap for conducting a portion of the oil to the rivet;

said second pair of mutually adjacent side flanks defining a second spacing gap for conducting a portion of the oil to the rivet;

said first and second spacing gaps extending in said running direction (F);

hold-back means disposed in at least one of said spacing gaps adjacent the rivet for holding back the entrained particles while allowing the lubricating oil to reach the rivet;

said hold-back means being a first hold-back means disposed in said first spacing gap and said saw chain further including a second hold-back means disposed in said second spacing gap; and, said driving link having a rivet hole for receiving one of the rivets therein; said rivet hole defining an opening having a peripheral edge; each of said hold-back means including: a recess formed in one of said side flanks of one of said cutting link and said side link; and, a projection formed on the side flank of said driving link adjacent said one side flank so as to engage into said recess; said projection and said recess being adapted to each other so as to conjointly define a labyrinth interface having a clearance play (a); and, said projection being formed at the peripheral region of said opening of said rivet hole.

13. The saw chain of claim 12, said lower portion of said cutting link having a width of 1.3 mm and said driving link having a width of 1.58 mm, said clearance play (a) being approximately 0.04 mm and said projection extending approximately 0.04 mm above said side flank of said driving link.

14. A saw chain for a motor-driven chain saw equipped with a guide bar and a drive motor for imparting a force to the saw chain for moving the latter around the guide bar in a predetermined running direction (F), the chain saw being further equipped with lubricating oil supply means for supplying lubricating oil to the saw chain into which oil unwanted particles become entrained during the movement thereof around the guide bar, the saw chain comprising:

a plurality of cutting links, a plurality of driving links and a plurality of side links, the links being pivotally interconnected by rivets to define the saw chain;

each of said driving links having two side flanks;

each of said cutting links having a lower portion defining a cutting link side flank facing one of said driving link side flanks thereby providing a first pair of mutually adjacent side flanks through which one of the rivets passes;

each of said side links having a side link side flank facing the other one of said driving link side flanks thereby providing a second pair of mutually adjacent side flanks through which said one of the rivets passes;

said first pair of mutually adjacent side flanks defining a first spacing gap for conducting a portion of the oil to the rivet;

said second pair of mutually adjacent side flanks defining a second spacing gap for conducting a portion of the oil to the rivet;

said first and second spacing gaps extending in said running direction (F);

hold-back means disposed in at least one of said spacing gaps adjacent the rivet for holding back the entrained particles while allowing the lubricating oil to reach the rivet;

said hold-back means being a first hold-back means disposed in said first spacing gap and said saw chain further including a second hold-back means disposed in said second spacing gap; and, each of said hold-back means including a plate arranged in the spacing gap corresponding thereto for narrowing said spacing gap.

15. The saw chain of claim 14, said plate being made of spring steel.

16. The saw chain of claim 14, the drive link including a rivet hole for receiving one of the rivets therein and said rivet having a shank and a collar formed on said shank; and, said plate having an edge which extends directly up to the periphery of said collar and said plate having a thickness in the range of approximately 0.03 mm to 0.2 mm.

17. A saw chain for a motor-driven chain saw equipped with a guide bar and a drive motor for imparting a force to the saw chain for moving the latter around the guide bar in a predetermined running direction (F), the chain saw being further equipped with lubricating oil supply means for supplying lubricating oil to the saw chain into which oil unwanted particles become entrained during the movement thereof around the guide bar, the saw chain comprising:

a plurality of cutting links, a plurality of driving links and a plurality of side links, the links being pivotally interconnected by rivets to define the saw chain;

each of said driving links having two side flanks;

each of said cutting links having a lower portion defining a cutting link side flank facing one of said driving link side flanks thereby providing a first pair of mutually adjacent side flanks through which one of the rivets passes;

each of said side links having a side link side flank facing the other one of said driving link side flanks thereby providing a second pair of mutually adjacent side flanks through which said one of the rivets passes;

said first pair of mutually adjacent side flanks defining a first spacing gap for conducting a portion of the oil to the rivet;

said second pair of mutually adjacent side flanks defining a second spacing gap for conducting a portion of the oil to the rivet;

said first and second spacing gaps extending in said running direction (F);

hold-back means disposed in at least one of said spacing gaps adjacent the rivet for holding back the entrained particles while allowing the lubricating oil to reach the rivet;

each of said driving links having a rivet hole formed therein for accommodating a rivet therein and said rivet having a shank and a collar formed on said shank and disposed in said rivet hole; said hold-back means including: a recess formed in said side flank of said lower portion of said driving link; a sleeve disposed in said rivet hole in surrounding relationship to said collar; and, said sleeve projecting outwardly beyond the side flank of said driving link and extending into said recess to define a labyrinth pass-through gap for the lubricating oil supplied to the rivet.

18. A saw chain for a motor-driven chain saw equipped with a guide bar and a drive motor for imparting a force to the saw chain for moving the latter around the guide bar in a predetermined running direction (F), the chain saw being further equipped with lubricating oil supply means for supplying lubricating oil to the saw chain into which oil unwanted particles become entrained during the movement thereof around the guide bar, the saw chain comprising:

a plurality of cutting links, a plurality of driving links and a plurality of side links, the links being pivotally interconnected by rivets to define the saw chain;

each of said driving links having two side flanks;

each of said cutting links having a lower portion defining a cutting link side flank facing one of said driving link side flanks thereby providing a first pair of mutually adjacent side flanks through which one of the rivets passes;

each of said side links having a side link side flank facing the other one of said driving link side flanks thereby providing a second pair of mutually adjacent side flanks through which said one of the rivets passes;

said first pair of mutually adjacent side flanks defining a first spacing gap for conducting a portion of the oil to the rivet;

said second pair of mutually adjacent side flanks defining a second spacing gap for conducting a portion of the oil to the rivet;

said first and second spacing gaps extending in said running direction (F);

hold-back means disposed in at least one of said spacing gaps adjacent the rivet for holding back the entrained particles while allowing the lubricating oil to reach the rivet; and, said hold-back means having an annular configuration and being arranged concentrically to the periphery of said rivet.

19. The saw chain of claim 18, said hold-back means being a first hold-back means disposed in said first spacing gap and said saw chain further comprising a second hold-back means disposed in said second spacing gap.

20. The saw chain of claim 18, said driving links having a rivet hole formed therein; and, each of said hold-back means comprising a first recess formed in one of said side flanks in the region of said rivet hole and a second recess formed in the side flank adjacent said one side flank directly opposite said first recess; said hold-back means comprising a sealing ring seated in said recesses so as to extend across the spacing gap; and, said sealing ring being made of a material permeable to the lubricating oil.

21. The saw chain of claim 20, said sealing ring being an injection molded sealing ring.

22. The saw chain of claim 18, each of said driving links having a rivet hole formed therein; and, said rivet hole having an opening in the side flank of the driving link; each of said hold-back means comprising: a groove formed in the side flank of one of said side link and said cutting link in the region of said rivet hole; a recess defined by a bevel at the peripheral edge of said opening of said rivet hole; said groove being approximately semicircular when viewed in section; and, said hold-back means comprising an oil-permeable sealing ring seated in said groove and said recess so as to extend across said spacing gap.

23. The saw chain of claim 18, each of said spacing gaps defining a path to the rivet extending therethrough; each of said hold-back means comprising a projection formed on one of said side flanks, said projection being directed toward said adjacent side flank so as to rerout said path.

24. The saw chain of claim 23, said one projection interdigitally engaging one annular recess formed on said adjacent side flank, said annular recess and said annular projection conjointly having a meander configuration when viewed in section.

25. The saw chain of claim 18, each of said hold-back means comprising two annular projections formed on one of said side flanks and one annular projection formed on the side flank adjacent to said one side flank so as to be directed toward said two annular projections to define a labyrinth pass-through gap for the lubricating oil.

26. The saw chain of claim 25, said hold-back means further comprising: one annular recess formed between said two annular projections for interdigitally engaging with said one annular projection; and, two annular recesses formed on respective sides of said one annular projection for interdigitally engaging with said two annular projections.

27. The saw chain of claim 26, said one annular recess and said one projection interdigitally engaging therewith and said two annular recesses interdigitally engaging with said two annular projections conjointly having a wave-shaped configuration when viewed in cross section.

28. The saw chain of claim 26, said two annular projections and said one annular recess formed on said one side flank and said one annular projection and said two annular recesses formed on said side flank adjacent to said one side flank conjointly defining a gap therebetween corresponding approximately to the magnitude of the spacing gap between said one side flank and said side flank adjacent to said one side flank.

29. The saw chain of claim 18, said driving link having a rivet hole for receiving one of the rivets therein; and, each of said hold-back means comprising a hold-back element formed on one of said side flanks directly next to said rivet hole.

30. The saw chain of claim 29, said hold-back element being a projection formed on the side flank of one of said cutting link and said side link and a recess formed on one of the side flanks of said driving link; and, said recess being formed by a bevel on one of the edges of said rivet hole.

31. The saw chain of claim 18, said driving link having a rivet hole for receiving one of the rivets therein; said rivet hole defining an opening having a peripheral edge; each of said hold-back means comprising: a recess formed in one of said side flanks of one of said cutting link and said side link; and, a projection formed on the side flank of said driving link adjacent said one side flank so as to engage into said recess; said projection and said recess being adapted to each other so as to conjointly define a labyrinth interface having a clearance play (a); and, said projection being formed at the peripheral region of said opening of said rivet hole.

32. The saw chain of claim 31, said lower portion of said cutting link having a width of 1.3 mm and said driving link having a width of 1.58 mm, said clearance play (a) being approximately 0.04 mm and said projection extending approximately 0.04 mm above said side flank of said driving link.

33. The saw chain of claim 18, each of said hold-back means comprising a plate arranged in the spacing gap corresponding thereto for narrowing said spacing gap.

34. The saw chain of claim 33, said plate being made of spring steel.

35. The saw chain of claim 33, the drive link including a rivet hole for receiving one of the rivets therein and said rivet having a shank and a collar formed on said shank; and, said plate having an edge which extends directly up to the periphery of said collar and said plate having a thickness in the range of approximately 0.03 mm to 0.2 mm.

36. The saw chain of claim 18, each driving link having two rivet holes for accommodating two of the rivets therein, respectively; said hold-back means comprising a cover plate arranged in one of said spacing gaps to narrow the width of the one spacing gap in the region of said cover plate; and, said cover plate having a configuration corresponding to a spectacles frame defining two apertures for receiving respective one of the two rivets therein.

37. The saw chain of claim 36, said cover plate being a first cover plate; and, said hold-back means further comprising a second cover plate arranged in the other one of said spacing gaps to narrow the width of said other spacing gap in the region of said second cover plate; and, said second cover plate likewise having a configuration corresponding to a spectacles frame defining two apertures for receiving said two rivets therein, respectively.

38. The saw chain of claim 18, each of said driving links having a rivet hole formed therein for accommodating a rivet therein and said rivet having a shank and a collar formed on said shank and disposed in said rivet hole; said hold-back means comprising: a recess formed in said side flank of said lower portion of said driving link; a sleeve disposed in said rivet hole in surrounding relationship to said collar; and, said sleeve projecting outwardly beyond the side flank of said driving link and extending into said recess to define a labyrinth pass-through gap for the lubricating oil supplied to the rivet.

* * * * *